US009404459B2

(12) United States Patent
McKaig et al.

(10) Patent No.: US 9,404,459 B2
(45) Date of Patent: Aug. 2, 2016

(54) PRESSURE COMPENSATED FUEL INJECTOR WITH SOLENOID PUMPING

(71) Applicant: McVan Aerospace, LLC, Vancouver, WA (US)

(72) Inventors: Ray McKaig, Vancouver, WA (US); Brian Donovan, Vancouver, WA (US)

(73) Assignee: McVan Aerospace, Vancouver, WA (US)

( * ) Notice: Subject to any disclaimer, the term of this patent is extended or adjusted under 35 U.S.C. 154(b) by 0 days.

(21) Appl. No.: 14/499,119

(22) Filed: Sep. 27, 2014

(65) Prior Publication Data

US 2015/0014449 A1 Jan. 15, 2015

Related U.S. Application Data

(62) Division of application No. 13/373,827, filed on Dec. 1, 2011, now Pat. No. 8,870,091.

(60) Provisional application No. 61/458,732, filed on Dec. 1, 2010.

(51) Int. Cl.

| | |
|---|---|
| ***F02M 51/06*** | (2006.01) |
| ***F02M 61/16*** | (2006.01) |
| ***F02M 57/02*** | (2006.01) |
| ***F02M 53/06*** | (2006.01) |

(52) U.S. Cl.

CPC ..... *F02M 61/167* (2013.01); *F02M 51/061* (2013.01); *F02M 53/06* (2013.01); *F02M 57/027* (2013.01)

(58) Field of Classification Search

CPC ..... F02M 51/061; F02M 51/0653; F02M 51/0657; F02M 51/0671; F02M 53/02; F02M 53/06; F02M 55/008; F02M 57/02; F02M 57/022; F02M 57/027; F02M 61/167

USPC ..... 239/5, 124–126, 132–132.5, 88, 585.2, 239/585.4, 585.5

See application file for complete search history.

(56) References Cited

U.S. PATENT DOCUMENTS

| | | | |
|---|---|---|---|
| 1,162,789 | A | 11/1915 | Loane, Jr. |
| 1,208,908 | A | 12/1916 | Burch |
| 1,376,277 | A | 4/1921 | Higgins, Jr. |
| 1,902,197 | A | 3/1933 | Thaheld |
| 1,856,852 | A | 5/1935 | Palisca |
| 2,052,459 | A | 8/1936 | Geiser |
| 2,055,580 | A | 9/1936 | Larsson et al. |
| 2,332,909 | A | 10/1943 | Fuscaldo |
| 2,385,239 | A | 9/1945 | Unsworth |

(Continued)

*Primary Examiner* — Christopher Kim
(74) *Attorney, Agent, or Firm* — John Bruckner PC

(57) ABSTRACT

A method includes: filling a chamber having a recirculating valve, a piston, a cap valve, an injector valve and an injection orifice with a liquid by closing the injector valve and circulating the liquid from a source through the recirculating valve and the cap valve; then isolating the chamber from the source by closing the recirculating valve and the cap valve then allowing pressure within the chamber to follow a cylinder pressure by mechanically coupling the cylinder pressure into the chamber; and energizing an injector coil with electric current that pulls a solenoid assembly in an upward direction opening the injector valve, further motion of the solenoid assembly drawing the piston upward, wherein liquid in the chamber is compressed by the piston to a higher pressure than the cylinder pressure, which has the effect of injecting an electronically controlled stream of liquid out of the chamber through the injection orifice.

8 Claims, 7 Drawing Sheets

Injector Assembly

(56) References Cited

U.S. PATENT DOCUMENTS

| | | | | |
|---|---|---|---|---|
| 2,530,128 | A | 11/1950 | Mashinter | |
| 2,602,702 | A | 7/1952 | Kovach | |
| 2,703,562 | A | 3/1955 | Seubert, Jr. | |
| 2,879,753 | A | 3/1959 | McKinley | |
| 2,917,034 | A | 12/1959 | Bessiere | |
| 3,005,118 | A | 10/1961 | Ranseen | |
| 3,081,758 | A | 3/1963 | May | |
| 3,456,628 | A | 7/1969 | Bassot et al. | |
| 3,662,987 | A | 5/1972 | Schlagmuller et al. | |
| 3,680,782 | A | 8/1972 | Monpetit et al. | |
| 3,702,683 | A | 11/1972 | Sturmer | |
| 3,802,626 | A | 4/1974 | Regneault et al. | |
| 3,839,943 | A | 10/1974 | Ufnalewski | |
| 3,882,833 | A | 5/1975 | Longstaff et al. | |
| 3,967,597 | A | 7/1976 | Schlagmuller et al. | |
| 4,062,327 | A | 12/1977 | Knights | |
| 4,097,833 | A | 6/1978 | Myers | |
| 4,116,389 | A | 9/1978 | Furtah et al. | |
| 4,197,996 | A | 4/1980 | Giardini | |
| 4,247,044 | A | 1/1981 | Smith | |
| 7,066,400 | B2 * | 6/2006 | Brenk et al. | 239/124 |
| 7,111,613 | B1 * | 9/2006 | Barnes et al. | 123/467 |

* cited by examiner

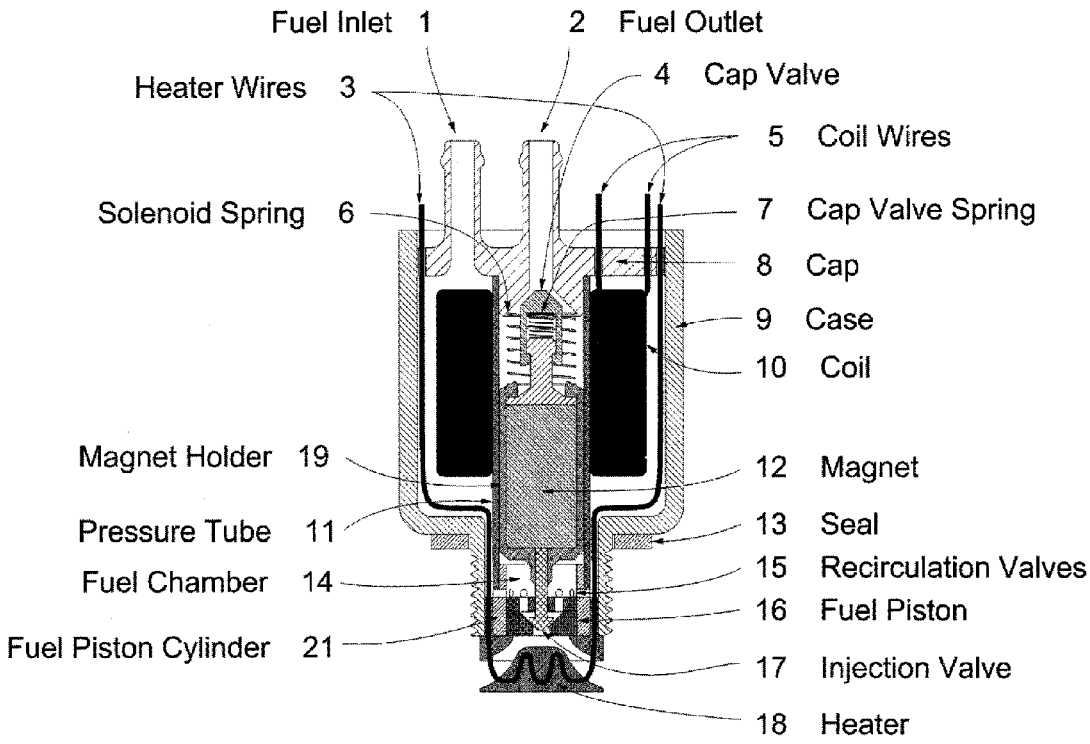
Figure 2 Injector Assembly

Solenoid Assembly

Solenoid Assembly with Solenoid Spring and Fuel Piston

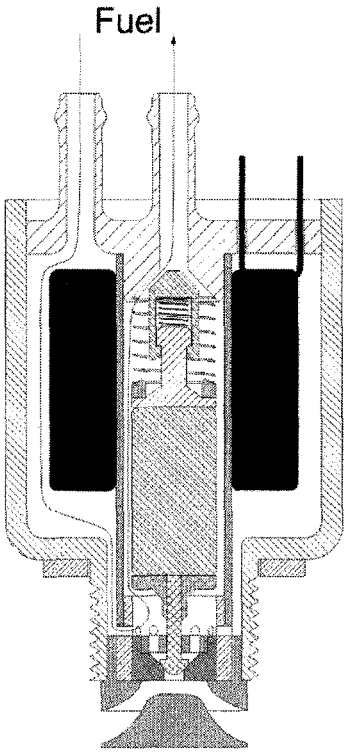
Figure 4 Recirculating Fuel Flow

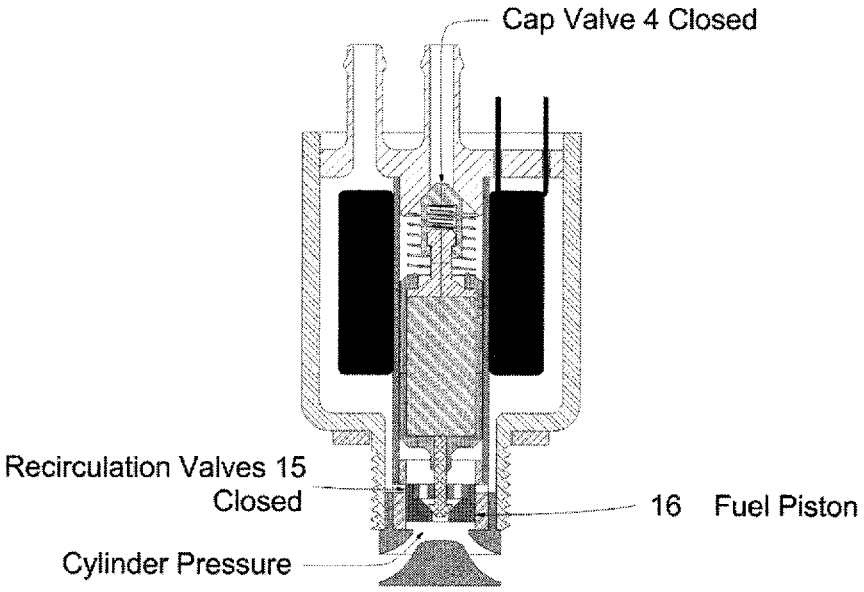
Figure 5 Cylinder Pressure Valve Closure

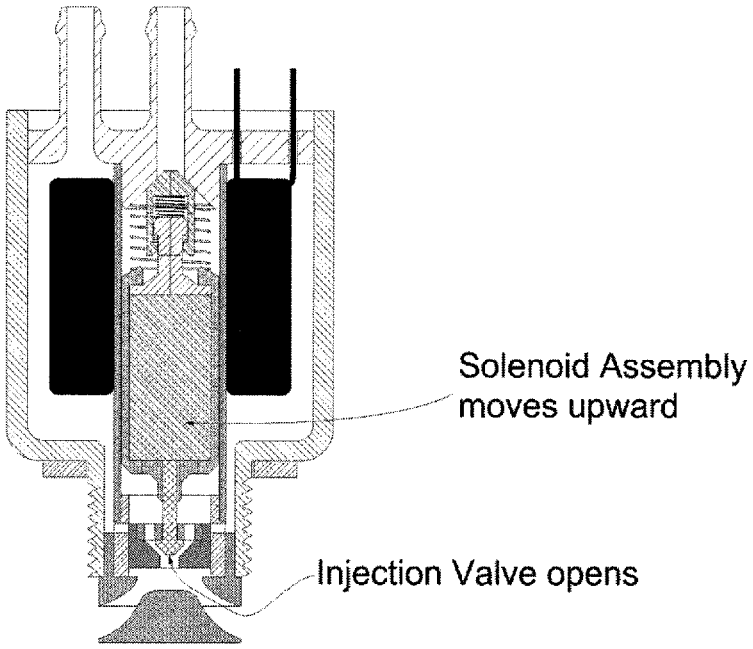
Figure 6 Solenoid Activation

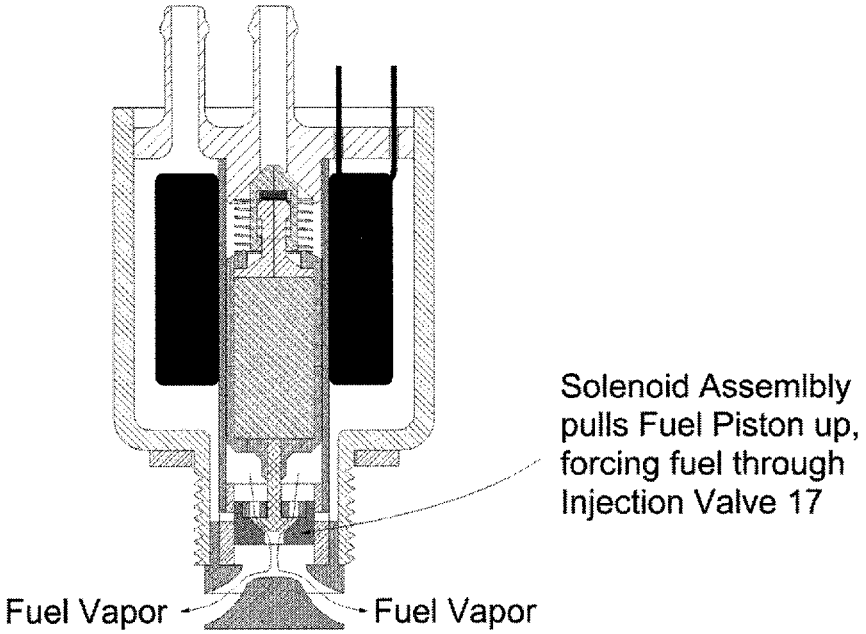
Figure 7 Fuel Injection

PRESSURE COMPENSATED FUEL INJECTOR WITH SOLENOID PUMPING

CROSS-REFERENCE TO RELATED APPLICATION

This application is a divisional of and claims a benefit of priority under 35 USC 120 from utility patent application U.S. Ser. No. 13/373,827, filed Dec. 1, 2011 (now U.S. Pat. No. 8,870,091) which in-turn claims a benefit of priority under 35 U.S.C. 119(e) from provisional patent application U.S. Ser. No. 61/458,732, filed Dec. 1, 2010, the entire contents of which are hereby expressly incorporated herein by reference for all purposes.

BACKGROUND INFORMATION

1. Field of the Invention

Embodiments of the invention relate generally to the field of fuel injection. More particularly, embodiments of the invention relate to pressure compensated fuel injection and pressure compensated fuel injectors.

2. Discussion of the Related Art

Although there are existing fuel injection systems for injecting fuel directly into engine combustion chambers, they typically suffer from several deficiencies. Some have dangerous extreme high pressure pumps to overcome cylinder pressures; some compensate internal combustion chamber pressures through various feedback tubes or complex pressure amplifiers. They depend on external glow plugs, spark plugs, or other ignition means which are physically separate from the injector causing ignition delays and inefficient combustion patterns. Most depend on high pressures to atomize fuel for better combustion efficiency. Some fail when bubbles are present in the injector's fuel chamber.

SUMMARY OF THE INVENTION

There is a need for the following embodiments of the invention. Of course, the invention is not limited to these embodiments.

According to an embodiment of the invention, a method comprises: filling a chamber having a recirculating valve, a cap valve and an injector valve with a liquid by closing the injector valve and circulating the liquid from a source through the recirculating valve and the cap valve; then isolating the chamber from the source by closing the recirculating valve and the cap valve; then equalizing a pressure within the chamber to a pressure outside the chamber by changing a volume of the isolated chamber; then opening the injector valve; and then reducing the volume of the isolated chamber to apply an over pressure within the chamber, thereby injecting fluid from the chamber.

According to another embodiment of the invention, an apparatus comprises a pressure compensated injector including: a cap defining an outlet; a pressure tube having a first end coupled to the outlet of the cap; a piston cylinder coupled to a second end of the pressure tube, the piston cylinder defining a recirculation valve between an exterior surface of the piston cylinder and an interior surface of the piston cylinder; a piston located within and in reversible sliding operational engagement with the interior of the piston cylinder to intermittently close the recirculation valve, the piston defining an injector orifice; a solenoid assembly located within and in sliding operational engagement with the pressure tube, the solenoid assembly including a magnet having a first end and a second end; a cap valve coupled to the first end of the magnet to intermittently close the outlet; a cap valve spring that applies a restorative force to the cap valve along a direction away from the first end of the magnet; an injection valve coupled to the second end of the magnet to intermittently close the injector orifice, the injection valve in sliding operational engagement with the piston; and a solenoid spring that applies a restorative force to the solenoid assembly along a direction away from the cap and intermittently open the outlet, open the recirculation valve and close the injector orifice, wherein the pressure tube, the piston cylinder, the recirculation valve, the piston, the injection valve, the cap and the cap valve define a chamber when a force on the piston along a direction toward the cap, in opposition to the restorative force of the cap valve spring and the restorative force of the solenoid spring, rises above a threshold, thereby closing the cap valve and the recirculation valve, and wherein energizing the solenoid when both the outlet and the recirculation valve are closed 1) opens the injector orifice and then 2) applies an additional force to the piston along the direction toward the cap, in opposition to the restorative force of the cap valve spring and the restorative force of the solenoid spring, thereby moving the piston toward the cap.

These, and other, embodiments of the invention will be better appreciated and understood when considered in conjunction with the following description and the accompanying drawings. It should be understood, however, that the following description, while indicating various embodiments of the invention and numerous specific details thereof, is given for the purpose of illustration and does not imply limitation. Many substitutions, modifications, additions and/or rearrangements may be made within the scope of an embodiment of the invention without departing from the spirit thereof, and embodiments of the invention include all such substitutions, modifications, additions and/or rearrangements.

BRIEF DESCRIPTION OF THE DRAWINGS

The drawings accompanying and forming part of this specification are included to depict certain embodiments of the invention. A clearer concept of embodiments of the invention, and of components combinable with embodiments of the invention, and operation of systems provided with embodiments of the invention, will be readily apparent by referring to the exemplary, and therefore nonlimiting, embodiments illustrated in the drawings (wherein identical reference numerals (if they occur in more than one view) designate the same elements). Embodiments of the invention may be better understood by reference to one or more of these drawings in combination with the following description presented herein. It should be noted that the features illustrated in the drawings are not necessarily drawn to scale.

FIG. 2 is a cross sectional view of the injector assembly of FIG. 1, representing an embodiment of the invention.

FIG. 4 is a cross sectional view of the injector assembly of FIG. 1 highlighting the recirculating fuel flow, representing an embodiment of the invention.

FIG. 5 is a cross sectional view of the injector assembly of FIG. 1 illustrating a configuration associated with a step of cylinder pressure valve closure, representing an embodiment of the invention.

FIG. 6 is a cross sectional view of the injector assembly of FIG. 1 illustrating a configuration associated with a step of solenoid activation, representing an embodiment of the invention.

FIG. 7 is a cross sectional view of the injector assembly of FIG. 1 illustrating a configuration associated with a step of fuel injection, representing an embodiment of the invention.

DESCRIPTION OF PREFERRED EMBODIMENTS

Figure 1:
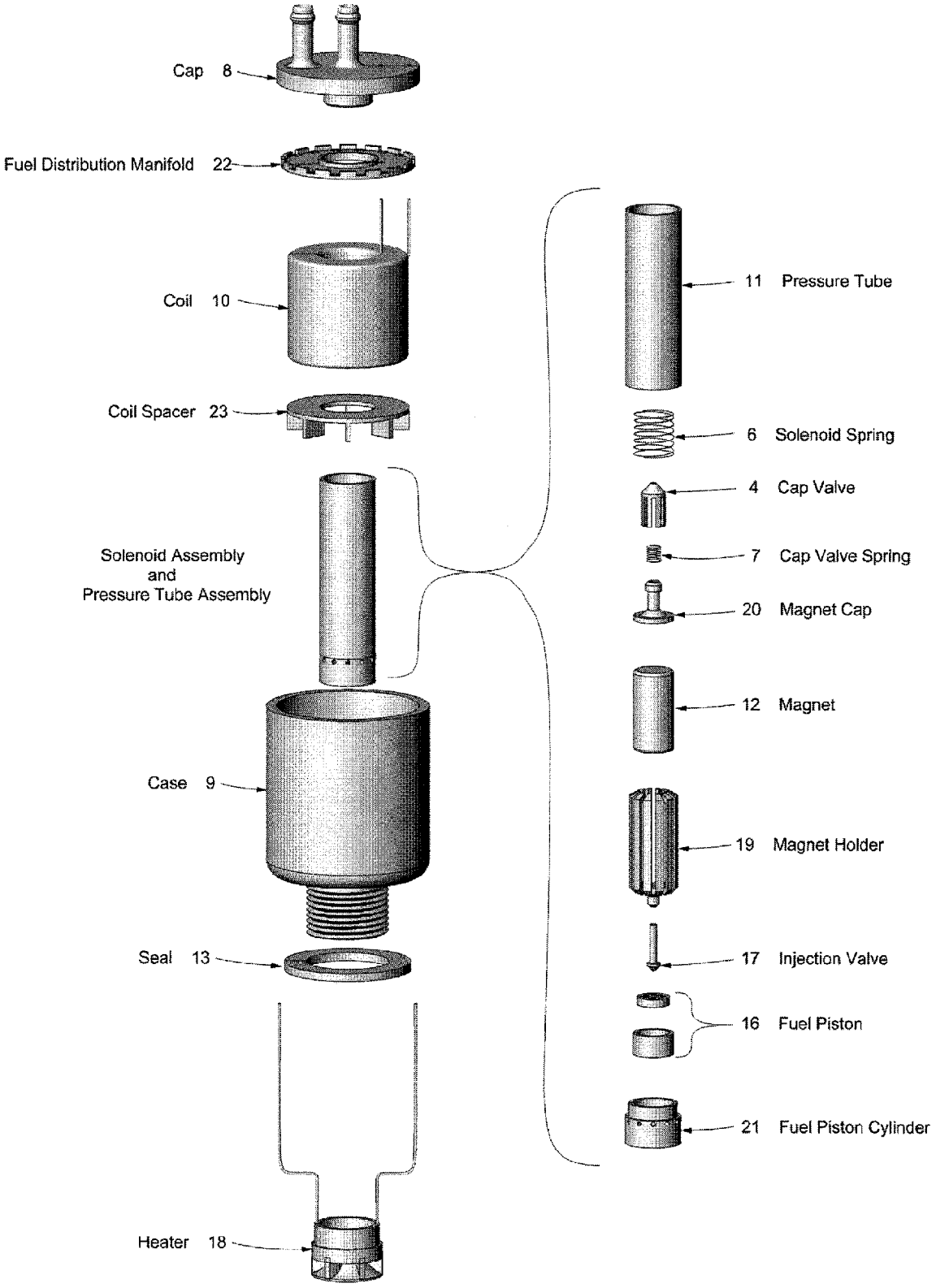
FIG. 1 is a composite exploded view of a pressure compensated fuel injector assembly, representing an embodiment of the invention.

Embodiments of the invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the embodiments of the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Overview of the Invention:

The context of the invention can include a pulsing-pressure combustion engine. For instance, the context of the invention can include an internal combustion engine equipped with an external low pressure recirculating fuel feed to reduce overheating, compress and remove bubbles as well as replenish a fuel supply by returning used (previously circulated) fuel to the fuel supply.

Embodiments of the invention can make use of mechanical and electronic devices in order to facilitate efficient direct fuel delivery within a pulsing-pressure engine. Embodiments of the invention can include a fuel injector for use within such a pulsing-pressure combustion engine. Thus, embodiments of the invention can be designed to inject fuel into a pulsing pressure engine when the pre-combustion pressure is substantially the highest. For instance, embodiments of the invention can be designed to inject fuel into an internal combustion engine cylinder using an electronic control circuit and a pressure compensated fuel injector when the piston is substantially at, or near, top dead center.

Embodiments of the invention can use combustion cylinder compression pressure to close one or more valves that isolate a pressure compensated injector's fuel chamber from the external fuel supply and all other injectors in the system. Thus, a pressure compensated fuel injector can include a fuel chamber that is externally-pressure-isolated when recirculating and cap valves are closed, thereby preventing pressure-coupling between injectors and allowing fuel pressure within the injector's fuel chamber to exactly follow cylinder pressure by mechanically coupling cylinder pressure into the injector's fuel chamber. The pressure-compensating fuel injector can have a geometry that minimizes the injector's fuel chamber pressure-compensation loop distance which reduces the delay for pressure compensation and the distance that fuel must travel during the injection process.

It is important to appreciate that by equalizing internal injector pressure with combustion chamber pressure, a small and relatively weak fuel pump is able to inject fuel into a pulsing pressure combustion engine's high-pressure combustion chamber. Embodiments of the invention can include a pressure-compensated fuel injector incorporating an electronically controlled pressure compensated solenoid-driven magnetic fuel pump. Such a pump can inject metered fuel into an internal combustion engine when the recirculating and cap valves are closed during the engine's combustion cycle, and reset the invention's recirculating and cap valves after each combustion cycle is complete. For instance, the pressure-compensated fuel injector can include a permanent magnet fuel pump that is driven by a solenoid coil.

Embodiments of invention can include an electronically controlled heating element in the injected fuel flow to vaporize fuel prior to mixing with hot compressed cylinder air. Thus, the invention can pre-heat and vaporize fuel to be injected prior to the fuel coming in contact with compressed gases to facilitate complete combustion. The pressure-compensated fuel injector can include an electronically controlled thermal fuel vaporizer. For instance, the pressure-compensated fuel injector can include an integral inline fuel vaporization heater located between the injector's injection valve and engine combustion chamber. In this case, the heated vaporized fuel can be well above its auto-ignition temperature, thus producing an immediate and rapid burn when coming in contact with oxygen in the compressed combustion chamber's air.

Embodiments of the invention can utilize fuel recirculation to reduce overheating, replenish fuel supply and remove bubbles. Embodiments of the invention can incorporate a low-pressure fuel recirculation system to provide cooling, to substantially eliminate bubbles and to replenish used (previously circulated) fuel to the fuel supply. The pressure-compensating fuel injector can have a geometry that substantially minimizes the injector's pressurized fuel volume which aids in recirculating fuel bubble removal.

Embodiments of the invention can facilitate exceptional fuel combustion efficiency through a unique hot fuel-vapor to air injection and mixing technique. In addition, embodiments of the invention can achieve their functionally with the utilization of a few parts.

Operation of the Invention:

In this section, the invention will be referred to as the Injector, and will be referenced as used in a piston driven internal combustion engine. During normal operation and using one or more Injectors per cylinder, the Injector replaces spark plugs, glow plugs, and other general fuel system components. An exploded view of all Injector components is depicted in FIG. 1. Before the engine is started, Recirculation Valves (FIG. 2, ref. 15) and Cap Valve (FIG. 2, ref. 4) are opened by Solenoid Spring pressure (FIG. 2, ref. 6) and by momentarily driving the Injector's Solenoid Assembly (FIGS. 3A and 3B) in its downward direction. This is accomplished by applying electric current to the Coil Wires (FIG. 2, ref. 5) in the direction that pushes the Injection Valve (FIG. 2, ref. 17) downward, which forces the Fuel Piston (FIG. 2, ref. 16) to its lowest and quiescent position.

Figure 3A:
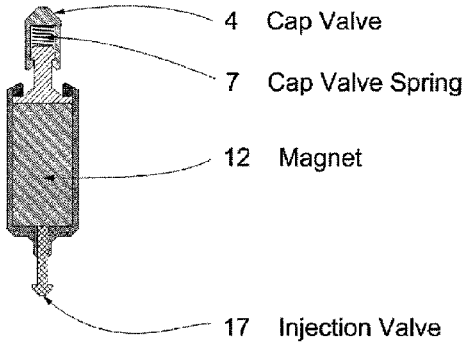
FIG. 3A is a cross sectional view of the solenoid subassembly, representing an embodiment of the invention.
Figure 3B:
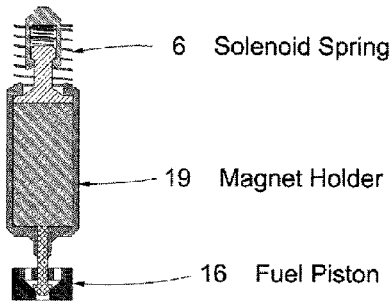
FIG. 3B is a cross sectional view of the solenoid subassembly with solenoid spring and fuel piston, representing an embodiment of the invention.
Figure 3C:
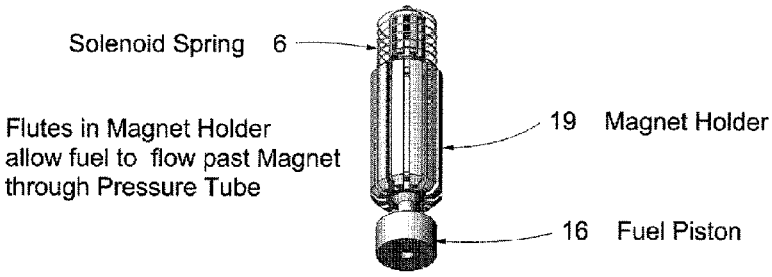
FIG. 3C is a perspective view of the solenoid subassembly with solenoid spring and fuel piston showing flutes in the magnet holder that allow fuel to flow past the magnet and through the pressure tube, representing an embodiment of the invention.

The fuel path flows from an external low-pressure fuel pump to all injectors in the system. Fuel recirculates through the injector (FIG. 4) to purge any bubbles within the Injector, replenish used fuel, and provide cooling. Fuel enters each injector through its fuel inlet (FIG. 2, ref. 1). Fuel is dispersed evenly by the Fuel Distribution Manifold (FIG. 1, ref. 22) to provide even flow around the injector's Coil (FIG. 2, ref. 10) for even cooling. Fuel then passes around Coil Spacer (FIG. 1, ref. 23), through Recirculation Valves (FIG. 2, ref. 15), and into the Fuel Chamber (FIG. 2, ref. 14). Fuel continues past Magnet (FIG. 2, ref. 12) for cooling, up through Cap Valve (FIG. 2, ref. 4), and through Fuel Outlet (FIG. 2, ref. 2) and back to the external fuel tank. FIG. 3C shows the Magnet Holder (FIG. 3C ref. 19) flutes that allow fuel to flow up through the Pressure Tube (FIG. 1 ref. 11) and around the Magnet (FIG. 1 ref. 12) during fuel recirculation mode.

When the engine is started, increasing cylinder pressure created by the engine's moving piston pushes against the Injector's pressure-compensating Fuel Piston (FIG. 5, ref. 16). This has the effect of moving the Fuel Piston upward and thus the Solenoid Assembly (FIG. 3A) upward also by pushing on the injector valve, which forces the Recirculation Valves (FIG. 5, ref. 15) and Cap Valve (FIG. 5, ref. 4) closed. The Cap Valve moves in conjunction with the Magnet by the Cap Valve Spring (FIG. 3A, ref 7). Once the recirculating fuel valves are closed, the Fuel Piston is unable to move farther due to the non-compressible hydraulic fuel in the Fuel Chamber (FIG. 2, ref. 14). Due to the motion of the Fuel Piston, the Injector's Fuel Chamber pressure follows the cylinder pressure exactly. When the engine's piston is at or near top dead center and fuel injection is ready to proceed, the Injector Coil (FIG. 2, ref. 10) is energized with electric current that pulls the Solenoid Assembly (FIG. 3A) in an upward direction. As depicted in FIG. 6, the moving Solenoid Assembly opens the fuel Injection Valve (FIG. 2, ref. 17). Further motion of the Solenoid Assembly draws the Fuel Piston upward as shown in FIG. 7. During this process, fuel in the Injector's fuel chamber is compressed by the Fuel Piston to a higher pressure than the cylinder pressure, which has the effect of injecting an electronically controlled stream of fuel out of the Injector's Fuel Chamber (FIG. 2, ref. 14) and into the engine's combustion chamber through the Injection Valve opening. On the way into the combustion chamber, the fuel encounters the glowing-hot Heater (FIG. 2, ref. 18) vaporizer that quickly heats the injected fuel to a gas as shown in FIG. 7. This hot vaporized fuel-gas expands rapidly and is expelled into and mixes with the already hot compressed combustion chamber air, igniting instantly. The amount of fuel and the rate of fuel flow into the combustion chamber are controlled by the electronics driving the Injector.

Once the combustion cycle is complete and the cylinder exhaust gasses are expelled, the engine cylinder pressure drops to a low value. At this time, the fuel pump solenoid is activated in the reverse direction which, in conjunction with Solenoid Spring (FIG. 2, ref. 6), pushes the Fuel Piston back to its quiescent position. This opens the recirculating fuel valves once again allowing fresh fuel to flow into the Injector fuel chamber, resetting the Injector for the next combustion cycle. Note that a vacuum pressure is created when moving the Fuel Piston back downward which momentarily opens the Cap Valve (FIG. 2, ref. 4) prior to the Recirculation Valves (FIG. 2, ref. 15) opening. This is necessary to relieve vacuum locking of the Solenoid Assembly, which would prevent the motion required for resetting the Injector prior to the next combustion cycle.

While the driving solenoid coil may be placed internally or externally, it is placed internally to facilitate cooling of the coil by the fuel flow. The Injector's fuel chamber incorporates a solenoid magnet for better power, which is also cooled by fuel flow. Although the Injector's fuel chamber can have several shapes and positions, the preferred embodiment has its placement as close to the Injector nozzle as possible, both to take advantage of cylinder heat and to reduce the distance the fuel must travel to the injection nozzle. In the preferred embodiment, the Injector is self-contained in a small package similar to a spark plug and is cylindrical in shape. The only external devices are the driving electronic module and low-pressure fuel pump.

Because the Injector's Fuel Piston is in direct contact with the engine combustion chamber's gasses through the Heater openings, variations in pressure within the combustion chamber are directly and substantially instantly felt and compensated for in the Injector's fuel chamber. This provides better control and consistency of delivered fuel since variations in cylinder pressure have no effect on the Injector's fuel metering operation.

Fuel passes over thermally sensitive components in the Injector, thus providing cooling and increased lifespan. Standard low-pressure fuel lines can be used with an external low-pressure recirculating fuel pump. No external ignition sources are necessary. The Injector has its own fuel heater-vaporizer. The entire pressure compensated fuel injector device resides in a single cylinder hole, similar to a spark plug. Control of the invention is by electronic means, thus improving reliability and accuracy of fuel delivery. The vaporizer heat and Injector solenoid currents are directly sensed and controlled. Injector replacement is quick and simple due to the Injector's standard low-pressure fuel and electronic connectors.

The heater should be shaped for optimum performance. For instance, the heater can be shaped as a horn, a spiral, a nautilus and/or other geometry. The invention can include various types of heater elements materials such as tungsten, ceramics, and/or catalyst coatings. Of course, there can be minor non-functional changes such as changes in the relative dimensions of the various functional parts. For instance, a different size coil, or magnet, or a narrower or wider fuel tube. The invention can include permanent magnets and other magnetic material compositions such as NdIB, SoCo, and/or ferrite. The invention can include different spring mechanisms such as a gas (e.g. fluidic) spring for Cap Valve Spring (FIG. 2, ref 7) or various spring materials such as steel, brass, and ceramics. The invention can include different sectionals from round to square or triangular, although round is the preferred embodiment.

DEFINITIONS

The term substantially is intended to mean largely but not necessarily wholly that which is specified. The term approximately is intended to mean at least close to a given value (e.g., within 10% of). The term generally is intended to mean at least approaching a given state. The term coupled is intended to mean connected, although not necessarily directly, and not necessarily mechanically. The term proximate, as used herein, is intended to mean close, near adjacent and/or coincident; and includes spatial situations where specified functions and/or results (if any) can be carried out and/or achieved. The term distal, as used herein, is intended to mean far, away, spaced apart from and/or non-coincident, and includes spatial situation where specified functions and/or results (if any) can be carried out and/or achieved. The term deploying is intended to mean designing, building, shipping, installing and/or operating.

The terms first or one, and the phrases at least a first or at least one, are intended to mean the singular or the plural unless it is clear from the intrinsic text of this document that it is meant otherwise. The terms second or another, and the phrases at least a second or at least another, are intended to mean the singular or the plural unless it is clear from the intrinsic text of this document that it is meant otherwise. Unless expressly stated to the contrary in the intrinsic text of this document, the term or is intended to mean an inclusive or and not an exclusive or. Specifically, a condition A or B is satisfied by any one of the following: A is true (or present) and B is false (or not present), A is false (or not present) and B is true (or present), and both A and B are true (or present). The terms a and/or an are employed for grammatical style and merely for convenience.

The term plurality is intended to mean two or more than two. The term any is intended to mean all applicable members of a set or at least a subset of all applicable members of the set. The term means, when followed by the term "for" is intended to mean hardware, firmware and/or software for achieving a result. The term step, when followed by the term "for" is intended to mean a (sub)method, (sub)process and/or (sub) routine for achieving the recited result. Unless otherwise defined, all technical and scientific terms used herein have the same meaning as commonly understood by one of ordinary skill in the art to which this invention belongs. In case of conflict, the present specification, including definitions, will control.

CONCLUSION

The described embodiments and examples are illustrative only and not intended to be limiting. Although embodiments of the invention can be implemented separately, embodiments of the invention may be integrated into the system(s) with which they are associated. All the embodiments of the invention disclosed herein can be made and used without undue experimentation in light of the disclosure. Although the best mode of the invention contemplated by the inventor (s) is disclosed, embodiments of the invention are not limited thereto. Embodiments of the invention are not limited by theoretical statements (if any) recited herein. The individual steps of embodiments of the invention need not be performed in the disclosed manner, or combined in the disclosed sequences, but may be performed in any and all manner and/or combined in any and all sequences. The individual components of embodiments of the invention need not be formed in the disclosed shapes, or combined in the disclosed configurations, but could be provided in any and all shapes, and/or combined in any and all configurations. The individual components need not be fabricated from the disclosed materials, but could be fabricated from any and all suitable materials.

Various substitutions, modifications, additions and/or rearrangements of the features of embodiments of the invention may be made without deviating from the spirit and/or scope of the underlying inventive concept. All the disclosed elements and features of each disclosed embodiment can be combined with, or substituted for, the disclosed elements and features of every other disclosed embodiment except where such elements or features are mutually exclusive. The spirit and/or scope of the underlying inventive concept as defined by the appended claims and their equivalents cover all such substitutions, modifications, additions and/or rearrangements.

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

What is claimed is:

1. A method, comprising operating a pressure compensated fuel injector including:

filling a fuel chamber defined by a pressure tube, a piston cylinder, a plurality of recirculation valves, a piston, an injection valve, an injection orifice, a cap and a cap valve with a charge of fuel by closing the injection valve and circulating a fuel from a fuel source through the plurality of recirculating valves and the cap valve; then isolating the fuel chamber and the charge of fuel from the fuel source by closing the plurality of recirculating valves and the cap valve; then allowing a fuel pressure within the fuel chamber to follow a cylinder pressure by mechanically coupling the cylinder pressure into the fuel chamber; and energizing an injector coil with electric current that pulls a solenoid assembly in an upward direction opening the injection valve, further motion of the solenoid assembly drawing the piston upward, wherein fuel in the fuel chamber is compressed by the piston to a higher pressure than the cylinder pressure, which has the effect of injecting an electronically controlled stream of fuel out of the fuel chamber and into an engine's combustion chamber through the injection orifice.

2. The method of claim 1, further comprising opening the plurality of recirculating valves and the cap valve before filling.

3. The method of claim 1, further comprising vaporizing the electronically controlled stream of fuel after it is injected from the fuel chamber.

4. The method of claim 1, further comprising externally recirculating fuel from the fuel chamber via the cap valve to the plurality of recirculating valves to reduce overheating, replenish the fuel source and remove bubbles from the fuel.

5. A method, comprising:

filling a chamber having a recirculating valve, a piston, a cap valve, an injector valve and an injection orifice with a liquid by closing the injector valve and circulating the liquid from a source through the recirculating valve and the cap valve; then isolating the chamber from the source by closing the recirculating valve and the cap valve; then allowing a fuel-pressure within the chamber to follow a cylinder pressure by mechanically coupling the cylinder pressure into the chamber; and energizing an injector coil with electric current that pulls a solenoid assembly in an upward direction opening the injector valve, further motion of the solenoid assembly drawing the piston upward, wherein liquid in the chamber is compressed by the piston to a higher pressure than the cylinder pressure, which has the effect of injecting an electronically controlled stream of liquid out of the chamber through the injection orifice.

6. The method of claim 5, further comprising opening the recirculating valve and the cap valve before filling.

7. The method of claim 5, further comprising vaporizing the liquid after it is injected from the chamber.

8. The method of claim 5, further comprising externally recirculating liquid from the chamber.

* * * * *